US009949340B2

(12) United States Patent
Yu

(10) Patent No.: US 9,949,340 B2
(45) Date of Patent: Apr. 17, 2018

(54) COLOR CHANGING LIGHT AND CONTROLLING METHOD AND APPARATUS THEREOF

(71) Applicant: NINGBO WELL ELECTRIC APPLANCE CO., LTD., Ningbo (CN)

(72) Inventor: Guolin Yu, Ningbo (CN)

(73) Assignee: NINGBO WELL ELECTRIC APPLIANCE CO., LTD., Ningbo (CN)

( * ) Notice: Subject to any disclaimer, the term of this patent is extended or adjusted under 35 U.S.C. 154(b) by 0 days.

(21) Appl. No.: 15/412,016

(22) Filed: Jan. 22, 2017

(65) Prior Publication Data

US 2017/0347426 A1 Nov. 30, 2017

(30) Foreign Application Priority Data

May 27, 2016 (CN) ..... 2016 1 0368870
Dec. 15, 2016 (CN) ..... 2016 1 1160105

(51) Int. Cl.
*H05B 37/02* (2006.01)

(52) U.S. Cl.
CPC ..... *H05B 37/0209* (2013.01); *H05B 37/0245* (2013.01)

(58) Field of Classification Search
CPC ..... H05B 37/0209; H05B 37/0245
USPC ..... 315/294, 320, 192
See application file for complete search history.

(56) References Cited

U.S. PATENT DOCUMENTS

| | | | | |
|---|---|---|---|---|
| 8,633,650 | B2 * | 1/2014 | Sauerlaender ..... | H05B 33/0809 315/192 |
| 2012/0181932 | A1 * | 7/2012 | De Hollan ..... | H05B 33/0809 315/113 |
| 2013/0293112 | A1 * | 11/2013 | Reed ..... | H05B 33/0863 315/131 |
| 2013/0313986 | A1 * | 11/2013 | Kim ..... | H05B 33/0809 315/192 |

* cited by examiner

*Primary Examiner* — Daniel D Chang
(74) *Attorney, Agent, or Firm* — Hemisphere Law, PLLC; Zhigang Ma

(57) ABSTRACT

The present invention discloses a color changing light and controlling method and apparatus thereof. The controlling method for a color changing light includes: each terminal of one way of four color substrate being connected together and acted as a common end, the common end being connected to a first voltage; two ways of the four color substrate being set up as a group, other terminals of the two ways being connected to a second voltage and a third voltage respectively; and polarities and voltages of the first voltage, the second voltage, and the third voltage being adjusted to turn on or turn off the four color substrate.

11 Claims, 5 Drawing Sheets

COLOR CHANGING LIGHT AND CONTROLLING METHOD AND APPARATUS THEREOF

This application claims the priority of Chinese patent application number 201611160105.9, filed on Dec. 15, 2016, the entire contents of which are incorporated herein by reference.

FIELD OF THE DISCLOSURE

The present invention relates to controlling apparatuses for lights, in particular, relates to a color changing light and a controlling method and a controlling apparatus for lights.

BACKGROUND OF THE DISCLOSURE

Color changing light chain is one kind of outdoor lights. Please refer to FIG. 5, a common terminal is set with a negative voltage, and a first terminal to a fourth terminal are set with positive voltages in series, such that to turn on a R-substrate, a G-substrate, a B-substrate, and a W-substrate in series. In other words, a RGBW light has 5 wires, which has a complex structure. In addition, a light chain with the RGBW light is in use, if one of the RGBW light is not at work, the light chain maybe replaced.

BRIEF DESCRIPTION OF THE DRAWINGS

In order to illustrate more clearly with prior arts or embodiment of the present invention, the figures needed to be used in the embodiments of the present invention or prior arts will be described briefly in the following section. It is noted that the figures described below only relate to some embodiments of the present invention. For ordinary person skilled in the art, some other drawings according to these drawings can be easily got without paying creative work.

DETAILED DESCRIPTION OF ILLUSTRATED EMBODIMENTS

To make the objectives, technical solutions, and advantages of the present invention clearer, the present invention is further described in detail in combination with specific embodiments and attached drawings. It should be understood that the embodiments described here are only exemplary ones for illustrating the present invention, and are not intended to limit the present invention.

Figure 1:
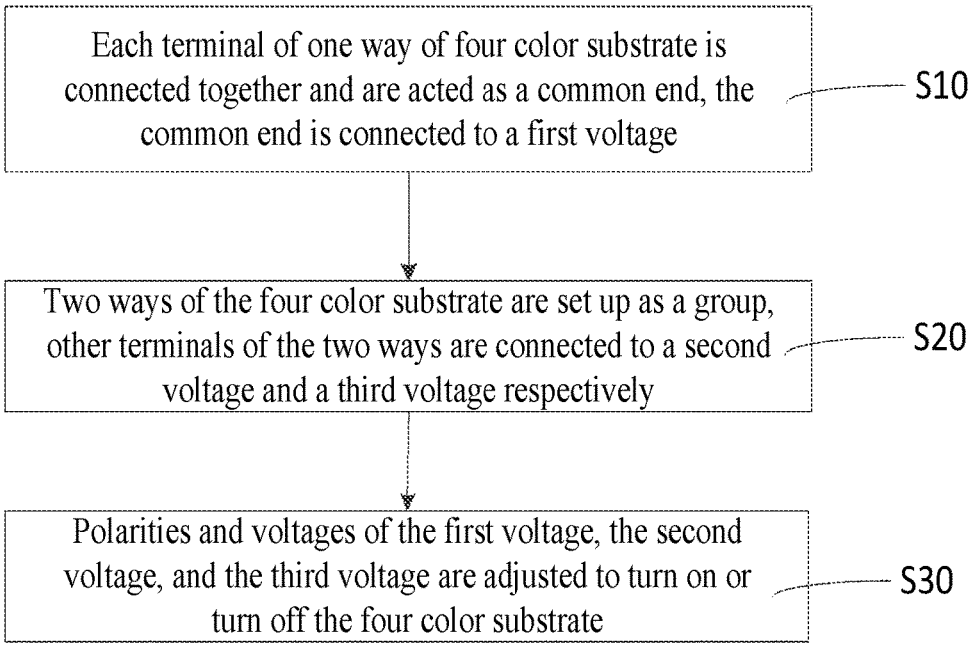
FIG. 1 is a flow chart of a controlling method for color changing lights according to an embodiment of the invention.

Please refer to FIG. 1, one embodiment of this invention provides a controlling method for a color changing light, includes the following steps:

Step 10: each terminal of one way of four color substrate is connected together and are acted as a common end. The common end is connected to a first voltage.

Step 20: two ways of the four color substrate are set up as a group. Other terminals of the two ways are connected to a second voltage and a third voltage respectively.

Step 30: polarities and voltages of the first voltage, the second voltage, and the third voltage are adjusted to turn on or turn off the four color substrate.

In one embodiment of this invention, program in a controller is rewritten to change the polarities of the second voltage and the third voltage. In this invention, the polarities of the second voltage and the third voltage are changed to change the color of the light, but not by controlling signals, such that to reduce the number of the wires from 5 to 3. In addition, there is no codec in the light. Such that the light has simple structure and low cost.

In another embodiment of this invention, two color substrate in one way is inversed connected. In other words, two substrates in one way are inversed connected to adjust the polarities of the second voltage and the third voltage, such that to turn on or turn off the two substrates. The embodiment of this invention can turn on or turn off the substrates with lesser controlling wires.

In another embodiment of this invention, a remote control transmitting circuit and a remote control receiving circuit are added. Buttons are set on the remote control transmitting circuit to adjust the polarities of the first voltage, the second voltage, and the third voltage.

One embodiment of this invention provides a controlling apparatus for a color changing light, includes a common end, a connection end, and a controlling module. Each terminal of one way of a four color substrate is connected together and are acted as the common end. The common end is connected to the first voltage. Two ways of the four color substrate are set up as a group. Other terminals of the two ways are acted as the connection end and are connected to the second voltage and the third voltage respectively. The controlling module is to adjust the polarities and the value of the first voltage, the second voltage, and the third voltage, such to turn on or turn off the four color substrate.

Figure 2:
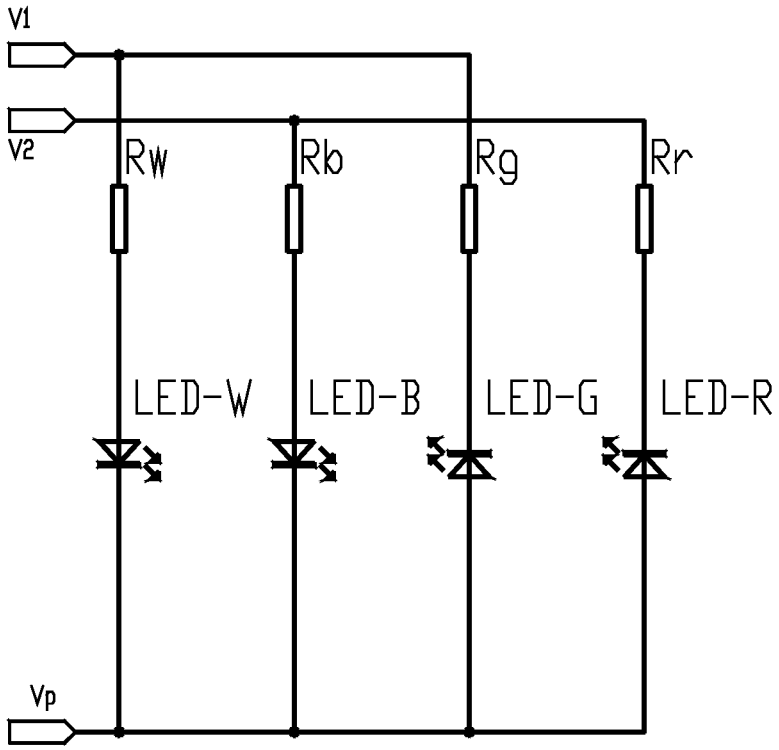
FIG. 2 is a schematic diagram of structure of a controlling apparatus for color changing lights according to an embodiment of the invention.

Please refer to FIG. 2, when the first voltage with negative voltage Vp is loaded on the common end, and the second voltage with positive voltage V1 is loaded on the other terminal of one of the two ways of the four color substrate, the R-substrate is turned on. When the third voltage with positive voltage V2 is loaded on the other terminal of other of two ways of the four color substrate, the B-substrate is turned on. When the first voltage with positive voltage Vp is loaded on the common end, and the second voltage with negative voltage V1 is loaded on the other terminal of one of the two ways of the four color substrate, the G-substrate is turned on. When the third voltage with negative voltage V2 is loaded on the other terminal of other of two ways of the four color substrate, the W-substrate is turned on. Such that, the color of the lights can be changed by three wires but not five wires.

In one embodiment of this invention, the four color substrate includes a base plate, a RGB color chip, and a white color chip. The RGB color chip and the white color chip are set oriented to a shell of the light for exporting rays when the light is on. The RGB color chip is set in an annular array around the white color chip.

Figure 3:
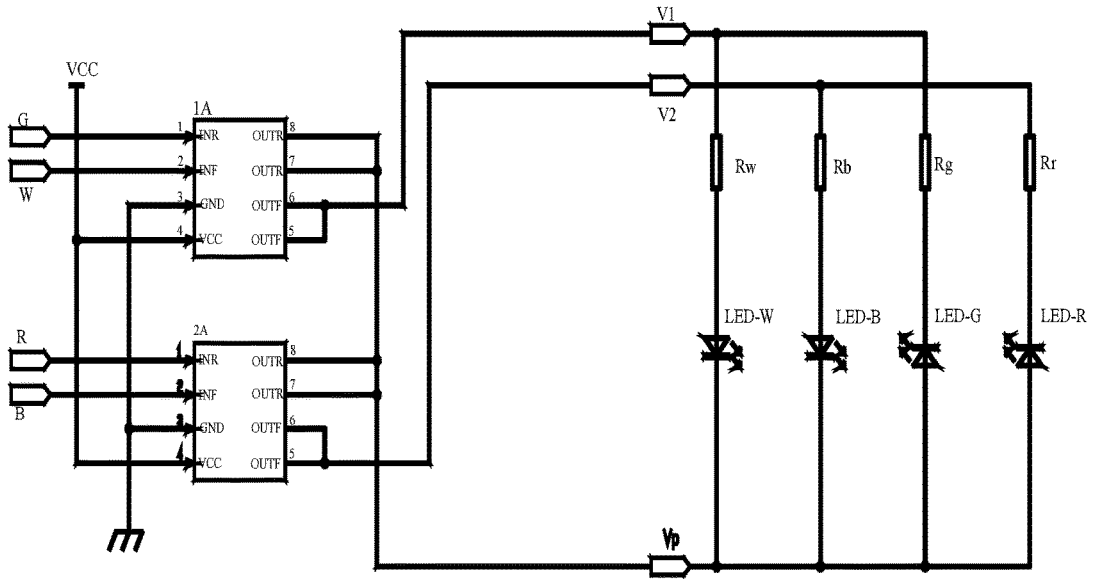
FIG. 3 is a schematic diagram of structure of a controlling apparatus for color changing lights according to another embodiment of the invention.

The controlling module rewrites program to change the polarities of the first voltage, the second voltage, and the third voltage. Please to refer to FIG. 3, the controlling module is controlled to adjust the polarities of the first voltage, the second voltage, and the third voltage. The type of the controlling module can be LG9110 chip.

Figure 4:
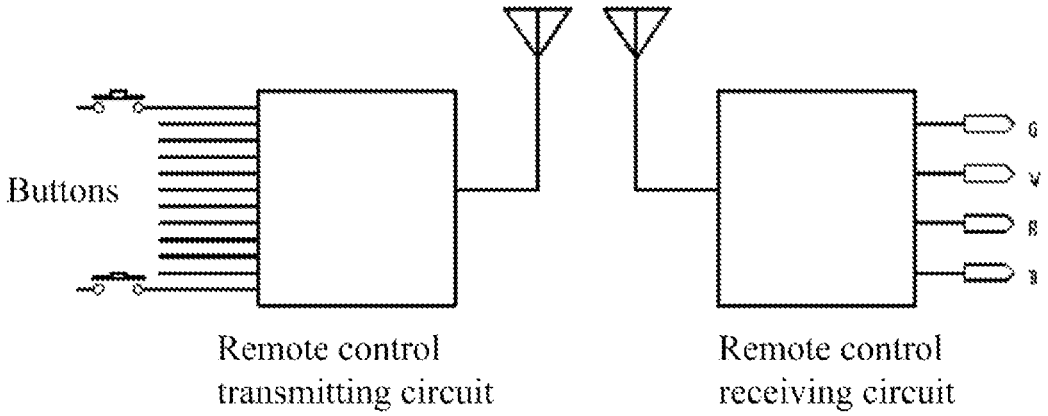
FIG. 4 is a schematic diagram of structure of a controlling module in the controlling apparatus for color changing light.
Figure 5:
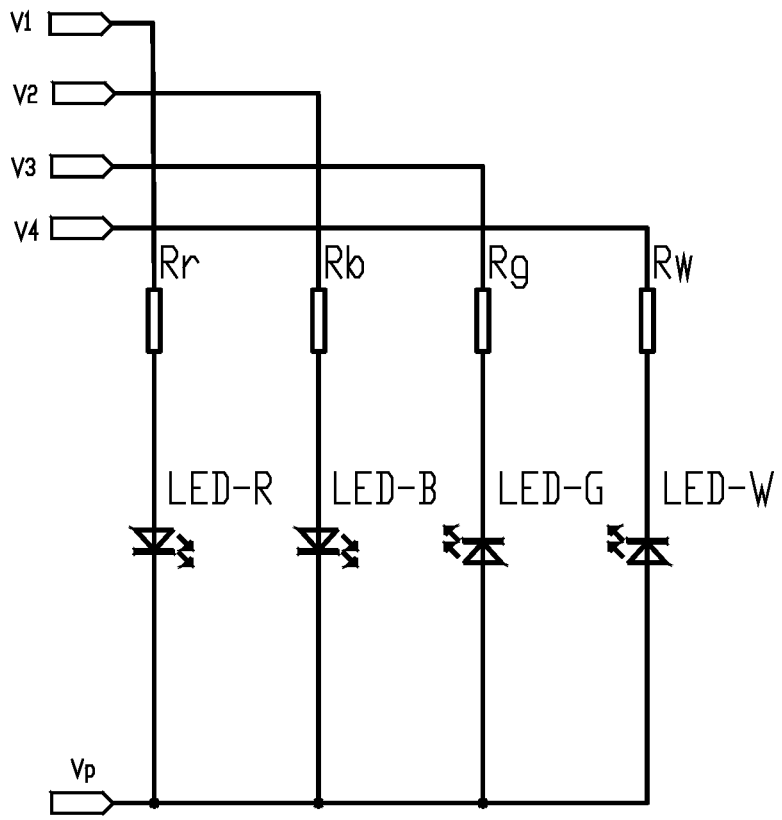
FIG. 5 is a schematic diagram of a color changing light in a related art.

Please refer FIG. 4, the controlling module further includes a remote control transmitting circuit and a remote control receiving circuit. Buttons are set on the remote control transmitting circuit to adjust the polarities of the first voltage, the second voltage, and the third voltage.

This invention further provides a color changing light. The color changing light includes at least one controlling apparatus above-mentioned and at least one light emitting assembly correspondingly which includes a R-substrate, a G-substrate, a B-substrate, and a W-substrate. The at least one controlling apparatus and the at least one light emitting assembly make up a light chain. The light emitting assemblies are controlled by the controlling apparatus to make the light chain be at work.

Described above are merely preferred embodiments of the present invention, but are not intended to limit the present invention. Any modification, equivalent replacement, or improvement made without departing from the spirit and principle of the present invention should fall within the protection scope of the present invention.

What is claimed is:

1. A controlling method for a color changing light, comprising:

connecting one terminal of each of four color substrates together to a common end, the common end being connected to a first voltage;

setting up two of the four color substrates as one group, setting up other two of the four color substrates as another group, connecting other terminals of the two of the four color substrates to a second voltage, and connecting other terminals of the other two of the four color substrates to a third voltage respectively; and adjusting polarities and values of the first voltage, the second voltage, and the third voltage by a rewritable program in a controller to turn on or turn off the four color substrates.

2. The controlling method for the color changing light of claim 1, wherein two color substrates in same group are inverse to each other.

3. The controlling method for the color changing light of claim 1, further comprising: setting a remote control transmitting circuit and a remote control receiving circuit, wherein the remote control transmitting circuit comprises buttons to adjust the polarities of the first voltage, the second voltage, and the third voltage.

4. A controlling apparatus for a color changing light, comprising:

a common end connected to each first terminal of four color substrates;

a first connection end connected to second terminals of two of the four color substrates set up as one group;

a second connection end connected to second terminals of other two of the four color substrates set up as another group; and a controlling module, wherein the controlling module is configured be programmed to adjust polarity and value of a first voltage connected to the common end, adjust polarity and value of a second voltage connected to the first connection, and adjust polarity and value of a third voltage connected to the second connection, such to turn on or turn off the four color substrates.

5. The controlling apparatus for the color changing light of claim 4, wherein two color substrates in same group are inverse to each other.

6. The controlling apparatus for the color changing light of claim 4, wherein the controlling module comprises a remote control receiving circuit being capable of communicated to a remote control transmitting circuit.

7. A color changing light, comprising:

at least one light emitting assembly comprising four color substrates, the four color substrates being a R-substrate, a G-substrate, a B-substrate, and a W-substrate each comprising a first terminal and a second terminal, two of the four color substrates being set up as a first group, and other two of the four color substrate being set up as a second group;

a common end connected to each first terminal of the four color substrates;

a first connection end connected to the second terminals of the two of the four color substrates of the first group;

a second connection end connected to the second terminals of the other two of the four color substrates of the second group; and a controlling module configured to be programmed to adjust polarity and value of a first voltage applied to the common end, adjust polarity and value of a second voltage applied to the first connection, and adjust polarity and value of a third voltage connected to the second connection to turn on or turn off the four color substrates.

8. The color changing light of claim 7, wherein two color substrates in same group are inverse to each other.

9. The color changing light of claim 7, wherein the four color substrates are four LEDs respectively emitting four light colors.

10. The color changing light of claim 7, wherein the controlling module is LG9110 chip.

11. The color changing light of claim 7, wherein the controlling module is configured to be programmed to turn on the R-substrate, the G-substrate, the B-substrate, and the W-substrate in series.

* * * * *